US005816773A

United States Patent [19]

Fehringer et al.

[11] Patent Number: 5,816,773

[45] Date of Patent: Oct. 6, 1998

[54] COLLATOR APPARATUS

[75] Inventors: Robert L. Fehringer, Camino; Christian E. Tammi, El Dorado Hills; Marc J. Fagan, Davis; Daniel M. Saldana, Rancho Cordova; Charles E. Preston, Orangevale, all of Calif.

[73] Assignee: International Billing Services, Inc., Rancho Cordova, Calif.

[21] Appl. No.: 588,714

[22] Filed: Jan. 19, 1996

[51] Int. Cl.[6] ..... B65G 57/00

[52] U.S. Cl. ..... 414/789.9; 364/478.13; 270/58.14

[58] Field of Search ..... 414/789.9, 790.2, 414/790.4, 790.6; 270/58.14, 58.15, 58.56; 364/478.06, 478.07, 478.08, 478.13

[56] References Cited

U.S. PATENT DOCUMENTS 4,453,870 6/1984 Bean ..... 414/789.9
4,750,853 6/1988 Van Soest et al. ..... 414/789.9
4,826,383 5/1989 Millen ..... 414/789.9
4,934,687 6/1990 Hayden et al. ..... 414/789.9
5,462,399 10/1995 Clupper et al. ..... 414/789.6

*Primary Examiner*—Karen M. Young
*Assistant Examiner*—Gregory A. Morse
*Attorney, Agent, or Firm*—James M. Ritchey

[57] ABSTRACT

A collating apparatus for collation of a plurality of pages or sheets having varying lengths or widths. A plurality of sheets of different lengths are provided to a collating tray with a stopper adjacent one end. The leading edge of each of the plurality of sheets registers against the stopper. When all of sheets have entered the collator tray and registered against the stopper, a plurality of pinch rollers are brought together on the front or leading edge of the stack of sheets, removing the stack of sheets from the collating tray.

8 Claims, 6 Drawing Sheets

COLLATOR APPARATUS

BACKGROUND OF THE INVENTION

1. Field of the Invention

The invention pertains generally to devices and methods for collating a plurality of paper sheets, and more particularly to a high-speed collating apparatus which collates paper sheets of different lengths for large volume mail operations.

2. Description of the Background Art

Large volume mailings, such as periodic billing operations and mass advertising, require high speed processing large numbers of mail packets or statements for delivery to customers or prospective customers. Periodic billing statements, such as those prepared in typical monthly billing operations, each generally include a plurality of pages, forms, or sheets of printed material which are ultimately sent to a customer in a single envelope. The billing statement must be correctly organized, collated, folded, and inserted into envelopes for mailing to customers. A variety of high-volume or bulk mail processing systems and methods are known for performing such mail preparation operations, and generally operate at high speeds under computer control.

An important problem in the background art mail processing systems is the lack of ability to quickly and efficiently collate multiple sheets or pages having varying lengths so that the collated sheets may subsequently be folded and inserted into envelopes. In a typical billing statement containing several sheets of printed material, one or more sheets are sometimes longer than the other sheets. In one billing format, for example, the first page of the billing statement is printed on an 8.5" by 14" form or sheet, while the remaining pages in the statement comprise 8.5" by 11" sheets. The longer form may include, for example, a detachable portion which is removed by the billing recipient and returned with a payment. Additionally, the billing statement may include one or more return envelopes which are generally shorter than the sheets or forms of the statement. The different lengths of the individual sheets and envelopes of the statement make it difficult to quickly and accurately collate the entire statement for subsequent folding and envelope insertion. Incorrect collation of the multiple sheets causes uneven folding and detracts from the overall appearance of the billing statement, which can lead to customer dissatisfaction. Incorrect collating also can cause jams in downstream folding and envelope insertion operations, leading to system shutdown and delays while the jam is cleared.

While various collating systems and devices have been previously disclosed, a system for collating multiple sheets of differing lengths for high speed, high volume mail processing operations is not presently known. There is thus a need for a multi-length sheet collating apparatus which can collate a plurality of sheets of several different lengths, which is quick and efficient, and which avoids system shutdowns associated with downstream jams due to incorrect collation. The present invention satisfies these needs, as well as others, and generally overcomes the deficiencies found in the background art.

SUMMARY OF THE INVENTION

An object of the invention is to provide a collating apparatus which can quickly and efficiently collate a plurality of pages or sheets of varying lengths.

Another object of the invention is to provide a collating apparatus that is controlled by a database directed computer and which is suitable for use in high-speed, high-volume, bulk mail processing systems.

A further object of the invention is to provide a collating apparatus which can quickly and efficiently collate a plurality of pages or sheets of varying lengths.

Still another object of the invention is to provide a collating apparatus for collating multiple mail statements wherein each mail statement can contain different compositions of a plurality of sheets of varying lengths.

Yet another object of the invention is to provide a collating apparatus which prevents system shutdowns due to downstream jamming during folding and envelope insertion operations caused by incorrect collation of a plurality of sheets of varying lengths.

Further objects of the invention will be brought out in the following portions of the specification, wherein the detailed description is for the purpose of fully disclosing the invention without placing limits thereon.

Disclosed is a collating apparatus for producing collated mail or billing statements which contain a plurality of sheets of varying or multiple lengths. In general terms, the invention comprises a collating tray, input means for providing a plurality of sheets or pages to the collating tray, stopping means for registering at least one edge of each of the plurality of sheets received from the input means, and means for removing the collated statements from the collating tray, which is preferably in the form of pinch roller means. The invention preferably also comprises output means for receiving the collated statements from the removing means and collating tray, means for actuating the stopping means and removing means, and control means for directing the operation of the input means and actuating means.

By way of example and not of limitation, the collating tray has a first end adjacent to the input means, and a second end adjacent to the stopping means and pinch roller means, with the second end of the collating tray preferably being positioned lower than the first end of the collating tray. The stopping means preferably comprises a stopper with one or more stop bars which move in a vertical fashion between a first position wherein the stop bars provide a surface against which an edge of the sheets of the statement may register during collation, and a second position which allows removal of the collated statement from the collating tray by the pinch roller means. The pinch roller means preferably includes a plurality of upper and lower pinch rollers which are brought together to frictionally engage the collated statement and remove the statement from the collating tray. Preferably, the stopping means and pinch roller means are interfaced together mechanically, electrically, by software, or by other means, so that both the stopping means and pinch roller means are actuated together by the actuating means, with the upper and lower pinch rollers coming together to engage and remove the collated statement at generally the same time that the stop bars move to allow the collated statement to leave the collating tray. The collating tray includes means for variably adjusting its width so that sheets of varying width may be collated.

The collating apparatus comprising the present invention is preferably operated by computer control means which is interfaced with data storage means. The data storage means contains a controlling data packet for the bulk mailing job which includes the information regarding the number of pages or sheets and the order of the sheets included in each statement. The control means is interfaced with the input means and actuating means of the collating apparatus, which are directed in their operation by system controlling software.

In the operation of the present invention, the individual printed sheets and forms for each billing statement are sequentially provided to the collating tray via the input means under the direction of the control means and according to the information in the controlling data packet. As each sheet is placed within the collating tray, it is directed towards the stop bars whereupon the leading edge of the sheet is registered. Guide means, preferably in the form of a guide bar and suitably placed deflectors, aid in directing and positioning the sheets of the statement so that they register against the stop bars. Sensing means which are interfaced with the control means monitor the movement of the sheets and indicates when each sheet of the statement enters the collating tray from the input means. When the sensing means has sensed or detected that each sheet required for a particular statement has entered the collating tray and registered against the stop bars, the actuating means is directed by the control means to lift the stop bars and bring the upper and lower pinch rollers together on the collated statement, removing the statement from the collating tray and placing the statement in the output means, from which the statement is then directed to downstream operations such as folding, envelope insertion, postage metering, an the like. When the sensing means indicates that the collated statement has cleared the collating tray, the control means directs the input means to provide the sheets or pages of the next statement to the collating tray, and the above procedure is repeated.

BRIEF DESCRIPTION OF THE DRAWINGS

The invention will be more fully understood by reference to the following drawings which are for illustrative purposes only.

DETAILED DESCRIPTION OF THE PREFERRED EMBODIMENT

Figure 4:
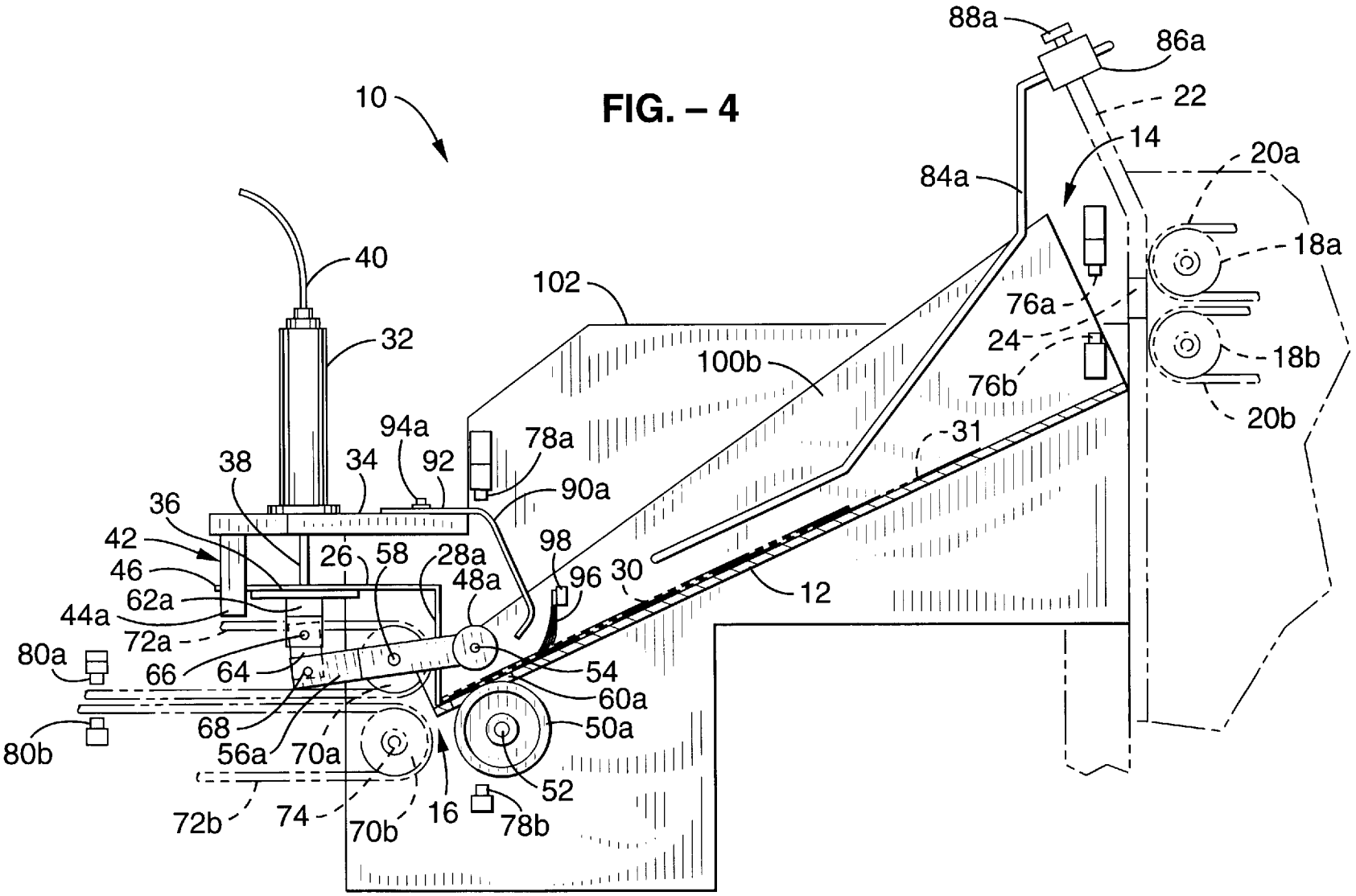
FIG. 4 is a side view of the collating apparatus of FIG. 1 showing a plurality of sheets in the collating tray registered against the stop bars.
Figure 5:
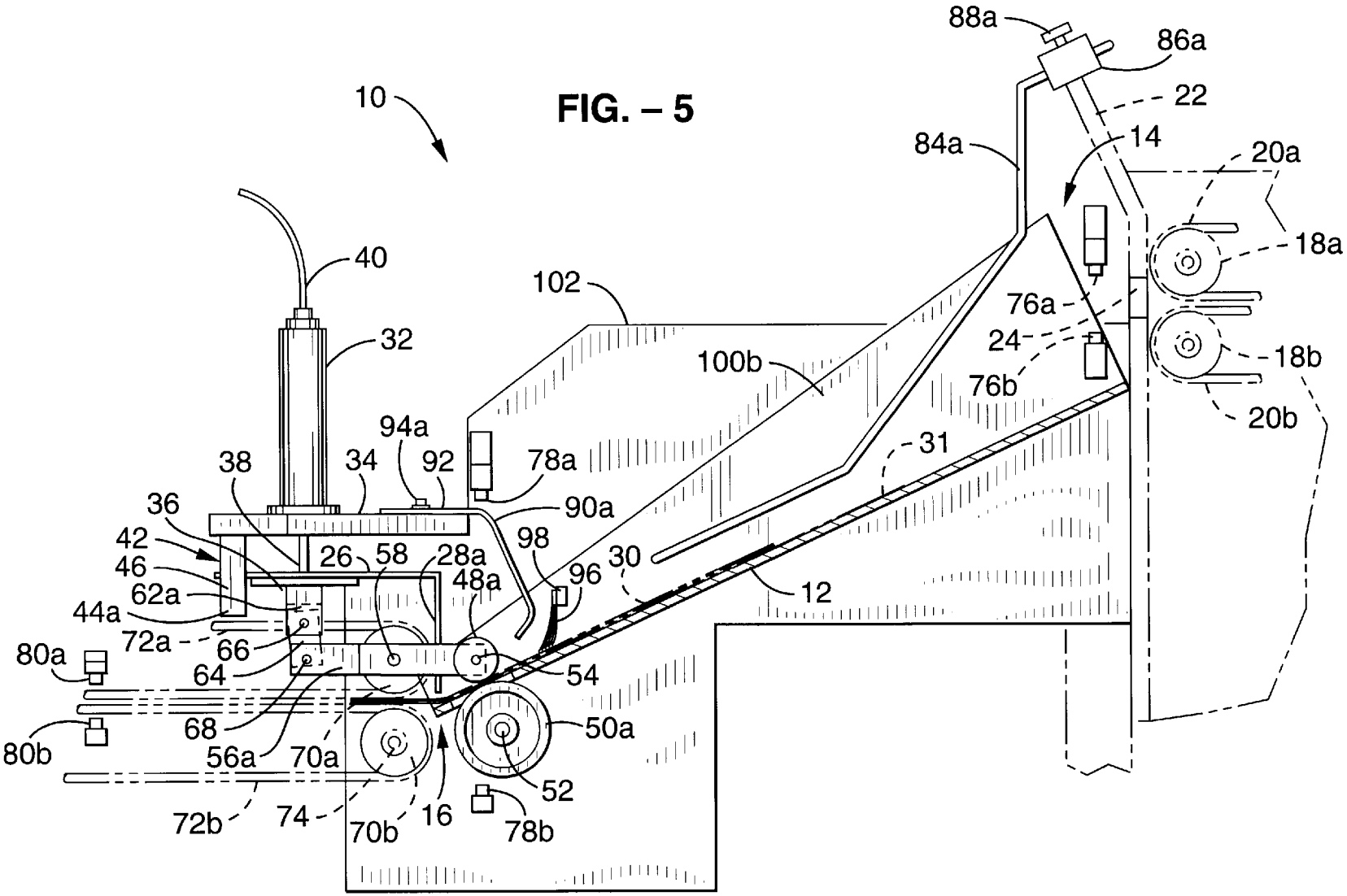
FIG. 5 is a side view of the collating apparatus of FIG. 1 showing a collated statement being removed from the collating tray by pinch rollers.
Figure 6:
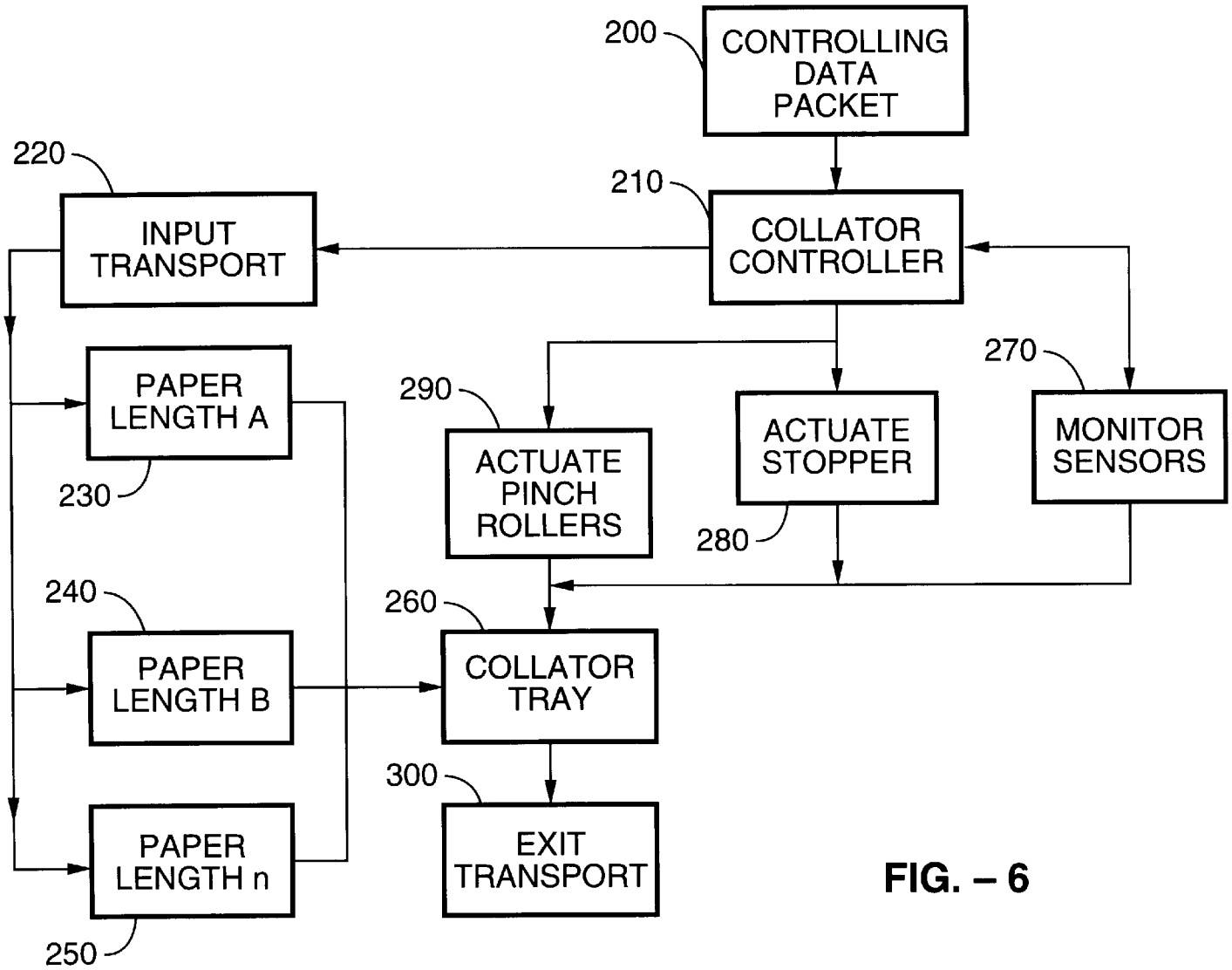
FIG. 6 is a flow diagram indicating a general control scheme for the collating apparatus comprising the present invention.

Referring more specifically to the drawings, for illustrative purposes the present invention is embodied in the collating apparatus or system which is generally shown in FIG. 1 through FIG. 5, and the flow diagram shown in FIG. 6. It will be appreciated by persons of ordinary skill in the art that the apparatus may vary as to configuration and as to details without departing from the basic concepts as disclosed herein.

Figure 1:
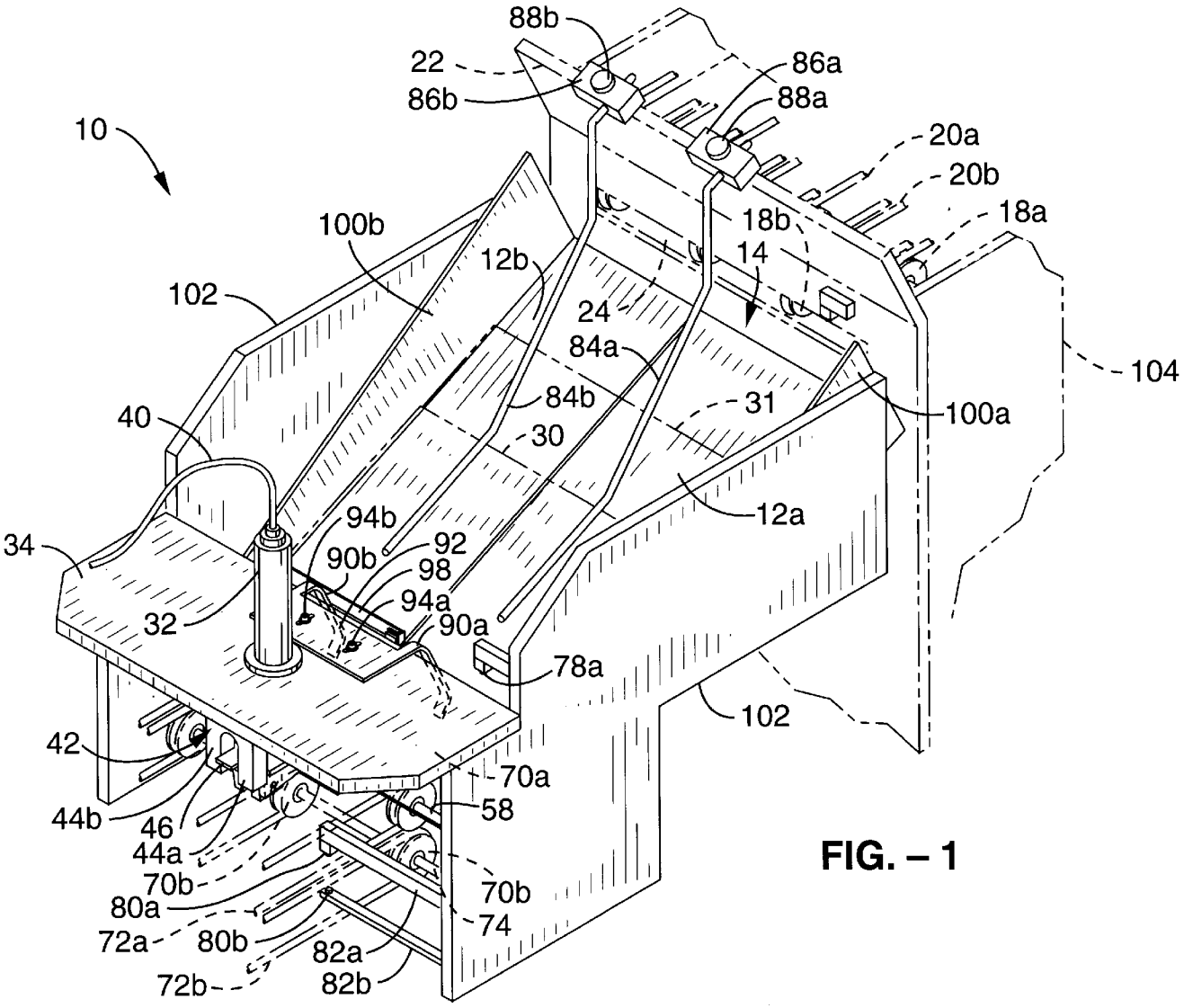
FIG. 1 is a perspective view of a collating apparatus in accordance with the present invention.
Figure 2:
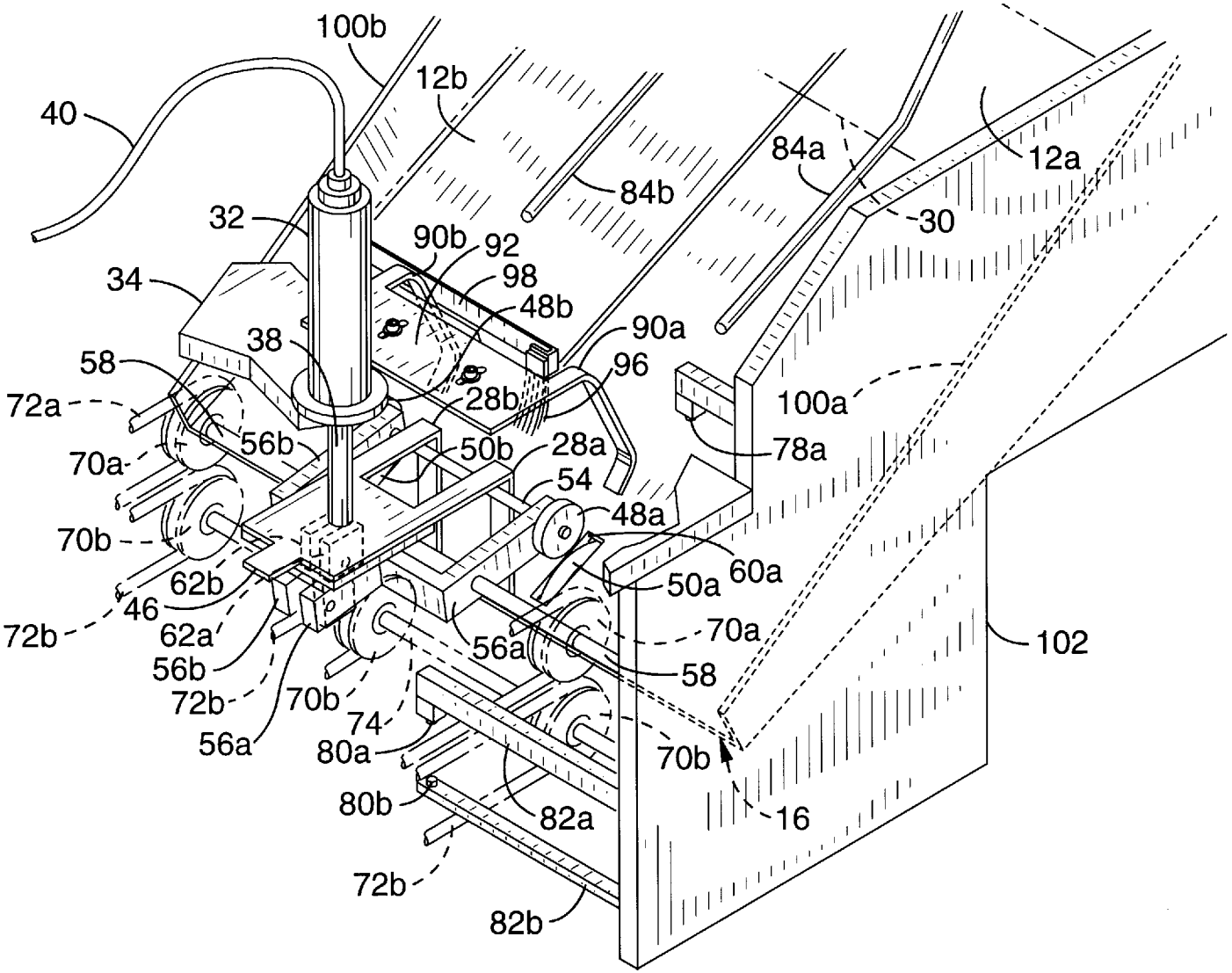
FIG. 2 is a perspective view of the pinch rollers, stopper, and actuator of the present invention.

Referring first to FIG. 1 through FIG. 5, there is shown generally a collating apparatus 10 in accordance with the present invention. The collating apparatus 10 includes a collating tray 12 of generally rectangular configuration to accommodate rectangular paper sheets or pages which comprise mail statements. Collating tray 12 preferably includes a first end 14 and a second end 16, with the first end 14 being positioned at a slightly higher position than the lower end 16 to provide gravity assistance in the collation operation, as described further below. Collating tray 12 is of generally rectangular configuration, and in the preferred embodiment collating tray 12 will generally have a width adequate for desired pages and in particular standard sized pages and sheets used in mail correspondence, i.e., about 8.5", international A-4, and the like. Collating tray 12 preferably includes width adjustment means for allowing quick and accurate collation of collections of sheets of various widths. A preferred width adjustment means comprises a split tray arrangement with tray halves or portions 12*a,* 12*b,* as shown in FIG. 1 and FIG. 2, which slidably translate relative to each other in a conventional manner with tray half 12*a* generally sliding over tray half 12*b,* allowing the width of collating tray 12 to be widened or narrowed as desired. The two halves of the collating tray 12*a* and 12*b* are fixed, relative to one another, by suitable locking means (not shown).

The collating tray 12 is of sufficient length between first and second ends 14, 16 so that pages or sheets of several lengths, such as 8.5' by 11", 8.5" by 14", 8.5" by 17", international A-4, and other lengths may be collated. In the preferred embodiment as shown in FIG. 1 through FIG. 5, sheets are registered and collated lengthwise or along the shorter edges of the sheets, as described further below. Collating tray 12, however, may alternatively be structured and configured in order to register and collate sheets by width or along the wider edges of the sheets. Thus, the present invention may be employed for collation of sheets of multiple widths as well as sheets of multiple lengths.

Input means for providing a plurality of sheets or pages to collating tray 12 are generally included with the invention and are mechanically interfaced with collating tray. The input means preferably comprises a conventional input transport system for paper sheets which includes upper pulleys 18*a* and lower pulleys 18*b,* and upper belts 20*a* and lower belts 20*b*. Upper and lower belts 20*a,* 20*b* form continuous, elongated loops which are associated with upper and lower pulleys 18*a* and 18*b* respectively at one end as well as a corresponding set of pulleys (not shown) at the other end of the elongated loops. Upper and lower pulleys 18*a,* 18*b* are positioned adjacent to each other and are spaced apart, usually vertically, at a suitable distance so that standard paper sheets or forms may be transported between upper and lower belts 20*a,* 20*b,* which frictionally engage the sheets. Upper and lower pulleys 18*a,* 18*b* and upper and lower belts 20*a,* 20*b* are rotationally driven by conventional means (not shown), and the action of the upper and lower belts 20*a,* 20*b* transports paper sheets forward for input into collating tray 12. Upper and lower belts 20*a,* 20*b* are generally made from an elastomeric material suitable for frictionally engaging paper sheets. A support member 22, which holds or supports upper and lower pulleys 18*a,* 18*b* of the input means in a conventional fashion, includes a slot 24 adjacent upper and lower pulleys 18*a,* 18*b* and first end 14 of collating tray 12. Sheets are directed from belts 20*a,* 20*b* and pulleys 18*a,* 18*b* into collating tray 12 through slot 24.

Other input means are also contemplated for use with the present invention. For example, paper sheets may be directed into collating tray 12 through a chute or channel by means of suitably positioned compressed air jets and/or vacuum sources, or other mechanical input means commonly used in the art. Compressed air jets and/or vacuum sources may additionally be used in conjunction with the belt and pulley input transport system described above, if desired.

The subject invention also includes stopping means for registering a plurality of sheets within the collating tray 12.

The stopping means preferably comprises a stopping member or stopper 26 which includes stop bars 28*a,* 28*b* positioned adjacent the second end 16 of collating tray 12, against which a plurality of sheets register or align. Referring more particularly to FIG. 2, a plurality of sheets comprising a mail statement or billing statement is shown generally as statement 30 which is aligned or registered against stop bars 28*a,* 28*b* adjacent collating tray second end 16. Other stopping means may be employed with the present invention if desired. For example, a block, plate, or any other stopping member structure which has a surface or other feature suitable for registering a plurality of sheets thereon may be substituted in place of the presently preferred stop bars 28*a,* 28*b* and stopper 26. As shown in FIG. 1 through FIG. 5, stop bars 28*a,* 28*b* are structured, configured, and positioned to register standard or other size paper sheets and forms along the leading edge in an end-wise manner or along the shorter edge of the sheets, in order to facilitate collation of stacks of sheets which are of multiple lengths. However, stop bars 28*a,* 28*b,* as well as collating tray 12, could alternatively be structured and configured for collating of sheets along the longer edge or width-collating, as mentioned above.

Figure 3:
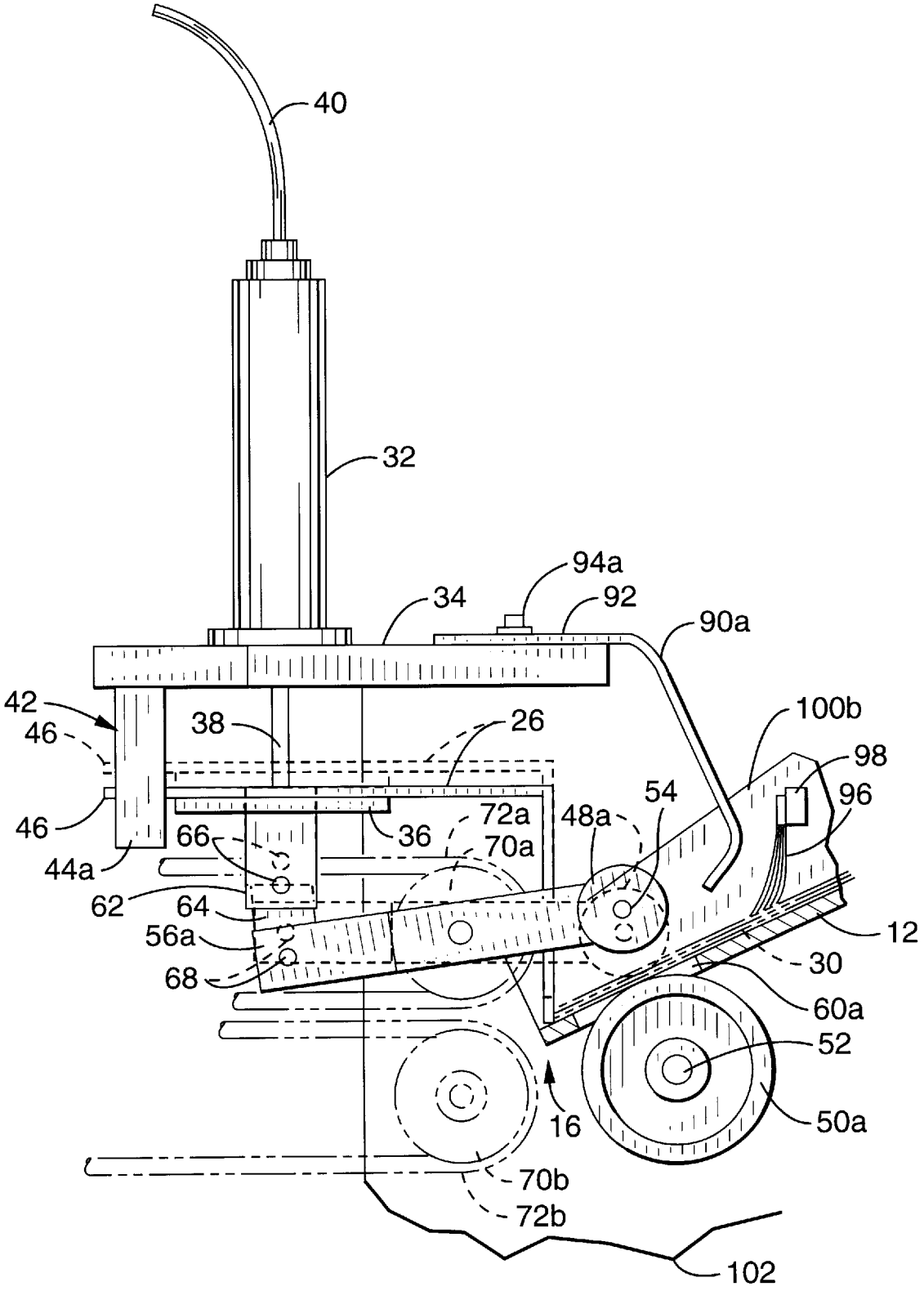
FIG. 3 is a side view of the pinch rollers, stopper, and actuator of the collating apparatus shown in FIG. 2.

Referring particularly to FIG. 2 through FIG. 5, the stopper 26 and stop bars 28*a,* 28*b* comprising the stopping means of the invention preferably move between two positions. In a first or sheet-registering position, shown in FIG. 3 and FIG. 4, stopper 26 and stop bars 28*a,* 28*b* are positioned so that the leading edge of each of the plurality of sheets of statement 30 registers against stop bars 28*a,* 28*b*. In a second or sheet-removing position shown in FIG. 5, stopping member 26 and stop bars 28*a,* 28*b* are positioned so that the collated statement 30 may be removed from collating tray 12 by suitable means as related below. In the presently preferred embodiment, the stopper 26 and stop bars 28*a,* 28*b* move in a generally vertical fashion (the exact orientation may vary from vertical to any other angle desired with corresponding changes to other positional references), with the "down" position for stopper 26 and stop bars 28*a,* 28*b,* wherein a plurality of sheets may register against stop bars 28*a,* 28*b,* and an "up" position wherein the collated sheets comprising statement 30 may be removed from collating tray 12. The subject invention requires that only one edge (the leading edge) of each rectangular sheet registers against stop bars 28*a,* 28*b*. The trailing edges of the sheets do not need to be aligned or registered, thus allowing collation of sheets of multiple lengths with the invention. Even though a typical "long" sheet 31 is seen in FIGS. 4 and 5 as the sheet on the bottom of the statement stack 30 and closest to the collating tray 12, other positions are within the realm and scope of this disclosure.

The stopping means of the invention could alternatively be structured, configured, and positioned so that sheets register against the stopping means while in an "up" position, with the stopping means moving downward to a "down" position, by descending below collating tray 12, to allow removal of the collated sheets. Similarly, horizontal or other directional movement may also be employed with the stopping means the present invention. For example, a horizontally moving gate or block may be employed as stopping means, with the gate sliding horizontally out of the way of the collated statement 30 to allow its removal from collating tray 12.

Means for actuating the stopping means are provided with the invention, so that the stopping means may be moved between the aforementioned first, sheet-registering position and second, sheet-removing position. Preferably, the actuating means for the stopping means comprises a compressed air actuator 32, shown mounted on a support platform 34. Stopper 26 and its attached stop bars 28*a,* 28*b* are coupled to a base 36, which in turn is attached to plunger rod 38. Compressed air actuator 32 drives plunger rod 38 vertically, thereby moving stopper 26 and stop bars 28*a,* 28*b* vertically between the first or sheet-registering position and the second or sheet-removing position. Compressed air line 40 provides compressed air to actuator 32 from a compressed air source (not shown). Other actuating means may alternatively employed for moving stopper 26, such as an electric motor actuator, a vacuum actuator, a hydraulic actuator, or other actuators commonly used in the art. A vertical guide member 42, with downwardly disposed forks 44*a,* 44*b,* is coupled to platform 34. Stopper 26 preferably includes a tab 46 which slidably fits between forks 44*a,* 44*b* of guide member 42 (FIG. 1), thereby preventing undesirable lateral motion of stopper 26 and stop bars 28*a,* 28*b* during actuation.

Also included with the present invention are means for removing the collated sheets from collating tray 12. In the preferred embodiment, pinch roller means are employed for removing the collated statement 30 from collating tray 12, preferably in the form of a plurality of upper pinch rollers 48*a,* 48*b,* and a plurality of lower pinch rollers 50*a,* 50*b*. Lower pinch rollers 50*a,* 50*b,* are rotationally mounted on horizontal rod 52, and are rotationally powered by suitable means (not shown). Upper pinch rollers 48*a,* 48*b,* are rotationally mounted by on rod 54, with rod 54 being coupled to pivot arms or brackets 56*a,* 56*b*. Pivot arms 56*a,* 56*b* are pivotally mounted on rod 58.

Removal of collated statement 30 is effected by bringing upper pinch rollers 48*a,* 48*b* and lower pinch rollers 50*a,* 50*b* together about collated statement 30 and frictionally engaging statement 30, with the rotational motion of lower pinch rollers serving to pull the statement 30 (from the front or leading edge) out of collating tray 12 and towards the output means, which is discussed further below. Upper and lower pinch rollers 48*a,* 48*b,* 50*a,* 50*b* are preferably brought together by pivoting arms 56*a,* 56*b,* which pivot about rod 58 so that upper pinch rollers 48*a,* 48*b* move downward until they come together with lower pinch rollers 50*a,* 50*b*. Collating tray 12 includes slots or channels 60*a,* 60*b* through which a portion of each lower pinch roller 50*a,* 50*b* protrudes. Upper and lower pinch rollers 48*a,* 48*b,* 50*a,* 50*b* preferably include an elastomeric surface (not shown) about their circumferences in order to facilitate frictional engagement with collated statement 30.

Upper pinch rollers 48*a,* 48*b,* are pivotally moved downward by suitable actuating means, which, in the preferred embodiment, is the same actuator 32 used for moving stopper 26 as described above. Preferably, actuation is provided for upper pinch rollers 48*a,* 48*b,* by means of a suitable linking mechanism that includes a pair of parallel, downwardly disposed vertical arms 62*a,* 62*b* which are coupled to base 36, with a joint member 64 fitting between vertical arms 62*a,* 62*b* and pivotally coupled thereto by pin 66. Joint member 54 is likewise interposed between arms 56*a,* 56*b* and pivotally coupled to arms 56*a,* 56*b* by pin 68. With this linking arrangement, when plunger rod 38 is vertically driven by actuator 32, vertical arms 62*a,* 62*b* and joint member 64 are actuated and thus arms 56*a,* 56*b* pivot about rod 58, and upper vertical rollers 48*a,* 48*b* accordingly move in a vertical fashion. Referring particularly to FIG. 2, FIG. 3, and FIG. 4, it can be seen that, when plunger rod 38 is moved downward and thus base 36 and stopper 26 are in a "down" or sheet registering position, upper pinch rollers 48*a,* 48*b* are pivotally moved via arms 56*a,* 56*b* into an "up"

position away from statement 30 and lower pinch rollers 50, 50*b*. When plunger rod 38 is moved upward, thereby moving stopper 26 upward into the "up" or sheet-removing position, upper pinch rollers 48*a*, 48*b* are pivotally moved downward to engage the sheets of statement 30 between upper pinch rollers 48*a*, 48*b* and lower pinch rollers 50*a*, 50*b*. Thus, both the pinch rollers 48*a*, 48*b* and stopper 26 and stop bars 28*a*, 28*b*, are simultaneously actuated by actuator 32, with upper pinch rollers 48*a*, 48*b* coming together with lower pinch rollers 50*a*, 50*b* at generally the same time that stop bars 28*a*, 28*b* move out of the way of statement 30, thereby allowing removal of the collated statement 30 from collating tray 12.

While the means for removing the collated statement 30 from collating tray 12 are generally described in this disclosure in terms of pinch roller means, it should be readily apparent to those of ordinary skill in the art that other means for removal of collated sheets from tray 12 are also suitable for use with the present invention. For example, clamp means may be used to grasp and remove collated statement 30 from tray 12. It is also contemplated that separate actuating means may be used with the invention for moving pinch rollers 48*a*, 48*b* together with lower pinch rollers 50*a*, 50*b*, rather employing the same actuator 32 as used for stopper 26 and stop bars 28*a*, 28*b*. The linking mechanism between plunger rod 38 and pivot arms 56*a*, 56*b* as described herein could alternatively be substituted with a standard universal joint.

The collated statement 30, upon being removed from collating tray 12 by pinch rollers 48*a*, 48*b*, 50*a*, 50*b* as related above, is then directed towards output means for receiving collated statement 30 and directing the collated statement 30 elsewhere to other mail processing operations. Preferably, the output means used with the invention comprises a conventional exit transport system which includes upper pulleys 70*a*, lower pulleys 70*b*, and upper belts 72*a* and lower belts 72*b*. As with the input transport system described above, belts upper and lower belts 72*a*, 72*b* form continuous, elongated loops which are associated with upper and lower pulleys 70*a* and 70*b* respectively at one end as well as a corresponding set of pulleys (not shown) at the other end. Upper and lower pulleys 70*a*, 70*b* are positioned adjacent to each other and are spaced apart vertically at a suitable distance so that standard paper sheets or forms may be transported between upper and lower belts 72*a*, 72*b* which frictionally engage the sheets. Upper and lower pulleys 70*a*, 70*b* and upper and lower belts 72*a*, 72*b* are driven by suitable means (not shown), and the action of upper and lower belts 72*a*, 72*b* transports collated statement 30 towards an exit gate (not shown) and other downstream mail processing operations, such as selective insert operations, folding, envelope insertion, postage metering, and the like. Upper and lower belts 72*a*, 72*b* are preferably made from an elastomeric material suitable for frictionally engaging paper sheets. Upper pulleys 70*a* are shown as rotationally mounted on rod 58, the same rod upon which arms 56*a*, 56*b* are pivotally mounted, in order to economize space and reduce the number of parts required for collator apparatus. However, upper pulleys 70*a* could alternatively be rotatably mounted on a rod or member other than rod 58, if desired. Lower pulleys 70*b* are rotationally mounted on rod 74.

The collating apparatus 10 comprising the present invention generally operates at high speeds and handles collation of large numbers of statements which differ from each other in the number of pages or sheets, types of sheets, and the length of individual sheets within the statement. Thus, the invention preferably operates under computer control to accommodate high operating speeds and variable statement compositions. The control means, which is discussed further below under the general control scheme of FIG. 6, preferably comprises a computer controller which directs the operation of actuator 32 and the input means of the invention. The control means monitors the position of statement 30 and individual sheets relative to collating tray 12 by sensing means. Generally, a plurality of suitably located sensors are used with the invention, and are interfaced to the control means. In the presently preferred embodiment, conventional photocells with a photoemitter and photodetector are employed. Preferably, a first sensor comprising a photoemitter and photodetector 76*a*, 76*b* is positioned adjacent first end 14 of collating tray 12 and adjacent to slot 24, for monitoring the input of individual sheets into tray 12 from the upper and lower pulleys 18*a*, 18*b* and upper and lower belts 20*a*, 20*b* of the input means. A second sensor comprising a photoemitter 78*a* and a photodetector 78*b* is positioned adjacent the second end 16 of collating tray 12 and stop bars 28*a*, 28*b* to monitor the presence or absence of sheets registered against stop bars 28*a*, 28*b*. Photoemitter 78*a* communicates with photodetector 78*b* through an aperture (not shown) in collating tray 12. A third sensor comprising a photoemitter 80*a* and a photodetector 80*b*, mounted on arms 82*a*, 82*b* (FIG. 1) respectively, is positioned adjacent to the output means to monitor the removal of collated statements from collating tray 12 by the upper and lower pulleys 70*a*, 70*b* and upper and lower belts 72*a*, 72*b* of the output means.

To further facilitate high speed operation of the collating system, guide means are generally employed with the invention to insure proper orientation of the sheets or pages in the collating tray 12. In the preferred embodiment, guide bars 84*a*, 84*b* are included, to direct sheets from the input means into collating tray 12 and in the general direction of stop bars 28*a*, 28*b*. Guide bars 84*a*, 84*b* are shown as mounted on support member 22 by clamps 86*a*, 86*b* and screws 88*a*, 88*b*. Other guide bar arrangements commonly used in the art may be employed with the subject invention. The guide means also preferably includes deflector bars 90*a*, 90*b* attached to plate 92 which is coupled to platform 34 by bolts 94*a*, 94*b*. Deflector bars 90*a*, 90*b* prevent sheets or pages from inadvertently sliding over upper pinch rollers 48*a*, 48*b*. Since the pages of statement 30 enter collating tray 12 at relatively high speeds, the leading edge of the sheets can bounce or recoil off of stop bars 28*a*, 28*b*, and interfere with subsequent sheets entering collating tray 12 from the input means. A brush 96, mounted on arm 98, provides a settling mechanism (necessary for high speed operations and material inconsistencies) to hold down or stabilize the sheets in statement 30, to serve as a paper check valve to prevent recoil or bouncing off of stop bars 28*a*, 28*b*, and to prevent improper interleaving of the sheets of statement 30. Other settling mechanisms, such as an elastomeric flap or compressed air/and or vacuum based systems may be employed with the invention as a settling mechanism. Compressed air and/or vacuum means may additionally be employed with collating tray 12 as shown in FIG. 1 through FIG. 5 to guide sheets to the proper location in tray 12 and to generally prevent mislocation of sheets and paper jams which would cause a system shutdown. First end 14 of collating tray 12 is preferably positioned higher than second end 16, to provide gravity assistance in directing sheets towards stop bars 28*a*, 28*b*. Tapered side walls 100*a*, 100*b* prevent unwanted lateral movement of sheets as they are directed across collating tray 12 towards stop bars 28*a*, 28*b*. The spacing or distance between side walls 100*a,* 100*b* may be varied by the width adjustment means discussed above, by slidably positioning tray halves 12*a,* 12*b* relative to each other. Collating apparatus 10 may be contained in housing 102 to protect the apparatus 10 and prevent inadvertent contact by persons with the sheets of statement 30 during the collating operation, which may result in injury to the persons and/or interruption of the collating operation. Likewise, a housing 104 may be provided to prevent contact with belts 20*a,* 20*b* and pulleys 18*a,* 18*b* of the input transport system, and a housing (not shown) can be included to protect the belts 72*a,* 72*b* and pulleys 70*a,* 70*b* of the exit transport system. Other equivalent arrangements of the sensors is considered to be within the domain of this disclosure.

Referring now to FIG. 6, there is shown a flow diagram indicating the general control scheme for the collating apparatus 10 comprising the present invention. In referring to FIG. 6, as well as FIG. 1 through FIG. 5, the method of using the present invention will be described generally in the context of a bulk mailing job wherein a large number of statements such as billing statements are prepared for mailing. Generally, data storage means containing a database for the bulk mailing job is employed with the invention, and the individual accounting and address information for each client or mail recipient to whom the statements will ultimately be mailed is stored in the data base. Other steps in the mail processing operation, such as the printing, separation, and organization (not shown) of the individual sheets for each statements, are generally carried out by conventional mail processing means according the information in the data base prior to the collating operation carried out by the subject invention.

The database or data storage means includes a controlling data packet 200 which contains all of the information necessary for collating the pages of the statements for a mailing job, including the number of pages, the types of pages and forms for each statement, and the order of the pages and forms within each statement.

A collator controller 210, which preferably comprises a computer or other control means, is interfaced with the database and in communication therewith, and receives information from the controlling data packet 200 contained therein. The database and controlling data packet 200 may physically be internal to collator controller 210, or external and linked thereto by suitable interface means.

A captive input transport 220 is controlled by collator controller 210. Input transport 220 provides or otherwise directs the sheets and forms of the mail statements for collation in the order required, according the information in controlling data packet 200. Input transport 220 is preferably a belt and pulley input transport system as described above, and is interfaced with a document preparation system (not shown) such as a Xerox 4635 printer which allows printing of forms and sheets of multiple sizes which are then separated, organized, and provided to the input transport 220 by standard means.

Each individual mail statement generally includes a plurality of pages or sheets of multiple lengths, which are shown in FIG. 6 as paper length A, 230, paper length B, 240, and additional paper lengths on up to paper length n, 250, depending on the type of mail or billing statement being prepared. Sheets of paper length A, paper length B, and paper length n (230, 240, and 250, respectively) are directed by the input transport 220, at the instruction of collator controller 210 and according to the controlling data packet 200, to collator tray 260.

Collator tray 260 is mechanically interfaced to input transport 220 in the manner described above, and includes a stopper, a pinch rollers, and a plurality of sensors interfaced with collator controller 210 as related above. Sheets of paper lengths A, B, and n (230, 240, and 250, respectively) are received by collator tray 260 from the input transport 220 as directed by collator controller 210, and are registered against the stopper.

Collator controller 210 monitors sensors 270 to detect the presence and location of sheets of paper lengths A, B, and n (230, 240, and 250, respectively) and the presence or absence of a statement against the stopper, as described above. When the monitoring of sensors 270 indicates to collator controller 210 that a complete mail or billing statement is collated and ready for removal from collator tray 260, collator controller 210 actuates stopper 280 and actuates pinch rollers 290 so that the pinch rollers grab or pull the collated statement from the front or leading edge and remove the statement from collator tray 260 and direct the statement to a semi-passive exit transport 300. Exit transport 300 is preferably a belt and pulley type exit transport system as described above. From exit transport 300, the collated statements are directed to further mail processing operations, such as folding and insertion into envelopes.

Accordingly, it will be seen that the present invention provides a collating apparatus which can quickly and efficiently collate a plurality of sheets or pages of multiple lengths. Although the description above contains many specificities, these should not be construed as limiting the scope of the invention but as merely providing illustrations of some of the presently preferred embodiments of this invention. Thus, the scope of the invention should be determined by the appended claims and their legal equivalents.

What is claimed is:

1. A collating apparatus for collating a predetermined number of equal or variable length sheets within a billing statement, comprising:

(a) a collating tray;

(b) inputting means for delivering each of the equal or variable length sheets into said collating tray;

(c) stopping means for registering each of the equal or variable length sheets within the billing statement in said collating tray, thereby collating the equal or variable length sheets;

(d) means for removing said collated equal or variable length sheets from said collating tray;

(e) sensing means for monitoring delivery of each said equal or variable length sheet in the billing statement within said collating tray;

(f) a database having billing statement information that establishes how many equal or variable length sheets are within the billing statement and the length of each equal or variable length sheet within the billing statement;

(g) control means in communication with said database for overseeing the operation of said inputting, stopping, removing, and sensing means.

2. A collating apparatus according to claim 1, wherein said removing means comprises a plurality of pinch rollers, said pinch rollers including a plurality of upper pinch rollers and a plurality of lower pinch rollers, said upper pinch rollers positioned adjacent said lower pinch rollers, said control means bringing said upper pinch rollers and said lower pinch rollers together.

3. A collating apparatus according to claim 1, wherein said stopping means is actuated between a first, sheet-registering position and a second, sheet-removing position.

4. A collating apparatus according to claim 1, further comprising means for adjusting the width of said collating tray.

5. An apparatus for collating a plurality of sheets, comprising:

(a) a collating tray;

(b) inputting means for delivering each of the equal or variable length sheets into said collating tray;

(c) stopping means for registering each of the equal or variable length sheets within the billing statement in said collating tray, thereby collating the equal or variable length sheets;

(d) pinch roller means for removing said collated equal or variable length sheets from said collating tray;

(e) means for actuating said stopping means between a first, sheet-registering position and a second, sheet-removing position;

(f) sensing means for monitoring presence and length of each said equal or variable length sheet in the billing statement within said collating tray;

(g) a database having billing statement information that establishes how many equal or variable length sheets are within the billing statement and the length of each equal or variable length sheet within the billing statement;

(h) control means in communication with said database for overseeing the operation of said inputting, stopping, pinch roller, and sensing means.

6. An apparatus according to claim 5, wherein said sensing means further comprises:

(a) a first sensor positioned adjacent said inputting means and said collating tray for sensing delivery and length of each equal or variable length sheet within the billing statement;

(b) a second sensor positioned adjacent said pinch roller means and said stopping means; and (c) a third sensor positioned adjacent said output means.

7. A collating apparatus according to claim 5, further comprising means for adjusting the width of said collating tray.

8. A collating apparatus according to claim 5, wherein said collating tray includes a first half and a second half, said first and second halves slidably related to each other to adjust a width for said collating tray.

* * * * *